United States Patent [19]

Schexnayder et al.

[11] 4,024,798

[45] May 24, 1977

[54] CONTROL VALVE PROVIDING TWO SPEED OPERATION FOR A MOTOR

[75] Inventors: Lawrence F. Schexnayder, Joliet; Wayne A. Peterson, Washington, both of Ill.

[73] Assignee: Caterpillar Tractor Co., Peoria, Ill.

[22] Filed: May 1, 1975

[21] Appl. No.: 573,683

[52] U.S. Cl. ..... 91/436; 137/625.66

[51] Int. Cl.[2] ..... F15B 11/08; F15B 13/042

[58] Field of Search ..... 91/436; 137/625.63, 137/625.66, 625.6

[56] References Cited

UNITED STATES PATENTS

| | | | |
|---|---|---|---|
| 2,502,547 | 4/1950 | Adams et al. | 91/436 X |
| 2,619,118 | 11/1952 | Adams | 137/625.68 |
| 3,267,966 | 8/1966 | Williams | 91/436 X |
| 3,621,881 | 11/1971 | Vicari | 137/625.66 |
| 3,862,643 | 1/1975 | Dezelan et al. | 137/625.66 X |
| 3,862,645 | 1/1975 | Bianchetta et al. | 137/625.69 |

*Primary Examiner*—Irwin C. Cohen

*Attorney, Agent, or Firm*—Phillips, Moore, Weissenberger, Lempio & Majestic

[57] ABSTRACT

A pilot operated, control valve providing for two speed operation of a hydraulic jack in a first direction, the control valve including centering spring means for resisting movement of its spool in either direction and additional spring means for resisting movement of the spool in the first direction in order to establish two operating positions of the spool corresponding to the two speeds of operation for the jack, the first operating speed being accomplished by communicating the rod end of the jack with a drain and simultaneously communicating a source of fluid under the pressure with a head end of the jack, the second operating speed being accomplished by communicating both ends of the jack with the pump, a pilot valve being manually operable to regulate the control valve and having first and second springs to indicate the operating position of the control valve spool and the corresponding speed of operation for the jack in the first direction.

2 Claims, 1 Drawing Figure

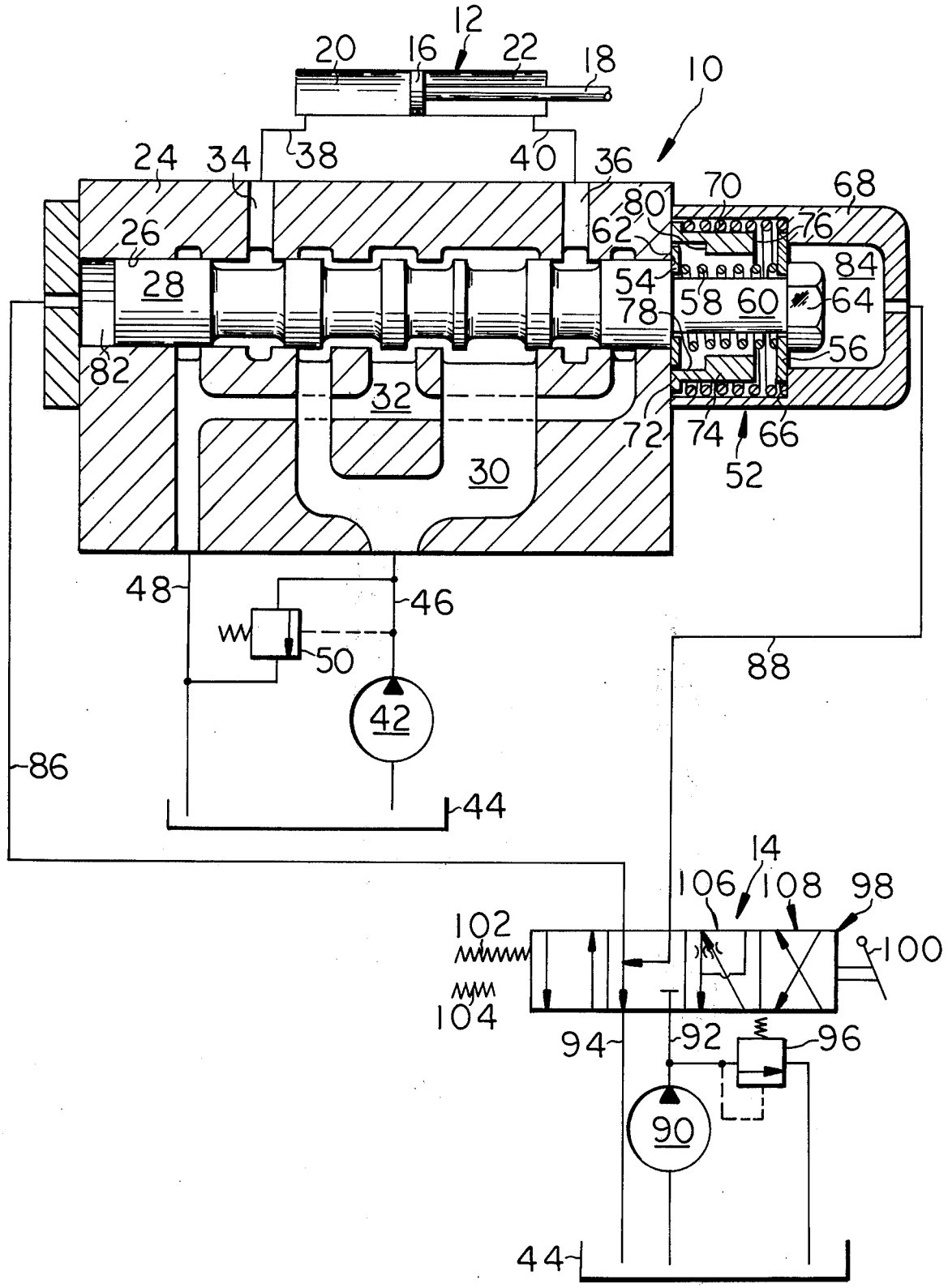
12
20
16
22
18
10
24
34
38
40
36
70
68
80
62
76
26
28
54
58
60
84
64
78
56
82
32
72
74
66
52
30
48
46
50
88
42
86
44
14
106
108
98
102
100
104
94
92
96
90
44

CONTROL VALVE PROVIDING TWO SPEED OPERATION FOR A MOTOR

BACKGROUND OF THE INVENTION

The present invention relates to a pilot operated, control valve and more particularly to such a control valve suitable for effecting two speed operation of a hydraulic jack in a first direction as well as providing for operation of the jack in the opposite direction.

Such control valve has numerous applications, particularly for regulating the operation of hydraulic jacks associated with implements on various material handling or earth moving machines. For example, the control valve is particularly contemplated for regulating a double-acting hydraulic jack coupled with an ejector in the bowl of an earth moving scraper. In this application, the ejector is movable forward through the bowl to unload material from the scraper. Two speed operation is desirable in order to rapidly sweep the ejector through the bowl when it encounters only a light load as well as to provide for lower speed, higher pressure operation of the ejector for removing heavy loads from the scraper. The jack may also be operable in the opposite direction in order to return the ejector to its normal loading position at the rear of the bowl.

Many types of control valves are available in the prior art for use in applications similar to that contemplated by the present invention. Initially, it is noted that many control valves are available to provide for two speed operation of a hydraulic motor or jack. In this regard, reference is made to U.S. Pat. No. 3,170,379 wherein a specially configured jack is responsive to two different control valves for accomplishing two speed operation. Similarly, U.S. Pat. No. 3,227,050, assigned to the assignee of the present invention, contemplates a control valve for effecting two speed operation of a hydraulic jack designed to similarly position an ejector within a scraper bowl.

Within a conventional hydraulic jack of a type having a cylinder and a piston with a connected rod penetrating one end of the cylinder, it is common to take advantage of the differential effective surface area on the piston for accomplishing two speed operation of the jack. For example, one operating speed may be established by communicating the larger effective surface area of the piston in the head end of the jack with a jump while communicating the rod end of the jack with a drain. Such a mode of operation provides for relatively low operating speed of the jack with relatively high operating force applied to the piston in the head end of the cylinder. For higher speed operation, the rod end of the jack may also be placed in communication with the pump. The jack still continues to operate in extension because of the differentially larger effective surface area in the head end of the cylinder. At the same time, exhaust fluid from the rod end of the jack provides make-up fluid for the head end of the jack.

This permits the jack to be extended at a higher speed but with effectively reduced operating force in the head end of the cylinder. Such a combination is contemplated for example by U.S. Pat. No. 2,619,118 and 3,633,461.

It has been discovered, however, that most control valves providing for such two speed operation of a jack are of relatively complex design. In addition, such control valves do not always provide for positive operator control over two speed operation of the jack. For example, two speed operation of the jack by the control valve may depend upon operating pressures within the system.

SUMMARY OF THE INVENTION

Accordingly, it is an object of the present invention to provide a relatively simple pilot operated control valve providing for two speed operation of a hydraulic jack.

It is a further object of the invention to provide such a control valve wherein the two operating speeds are positively accomplished by means of a stepped or differential spring assembly resisting movement of a spool within a valve bore.

It is also a further object of the invention to provide such a control valve further comprising a manually operable pilot valve for regulating the control valve and even more particularly providing a differential spring effect within the pilot valve in order to provide a positive signal to the operator as to whether the pilot valve is positioned to adjust the control valve for high or low speed operation of the jack.

Additional objects and advantages of the invention are made apparent within the following description having reference to the accompanying drawing.

DESCRIPTION OF THE DRAWING

A single FIG. illustrates a pilot valve, with parts in section, constructed according to the present invention, a hydraulic jack and other hydraulic components associated with the control valve being gererally illustrated in schematic form.

DESCRIPTION OF THE PREFERRED EMBODIMENT

The present invention is generally directed toward a control valve of the type indicated at 10 for regulating operation of a double-acting hydraulic jack 12. The control valve is of a type suitable for operation by a manually operable pilot valve indicated at 14. These components are described in greater detail below.

The hydraulic jack 12 is of a conventional type including a cylinder containing a slidable piston 16 secured to a rod 18 penetrating one end of the cylinder. The piston 16 accordingly divides the cylinder into two chambers which are conventionally termed its head end 20 and its rod end 22. Within such a combination, the piston 16 has a greater effective surface area exposed to the head end 20 of the cylinder as compared to its effective surface area in the rod end 22 because of the cross sectional area of the rod 18.

The control valve 10 includes a valve body 24 defining a bore 26 containing a longitudinally movable spool 28. The spool 28 is formed with a plurality of lands and interspaced grooves to selectively communicate various portions of the bore in a manner described in greater detail below.

The valve body 24 also forms a branched inlet passage 30 and a branched drain passage 32 in respsective communication with opposite end portion of the bore 26 and a central portion of the bore 26. The spool 28 has a conventional open-center configuration for cooperation with the passages 30 and 32. In addition, the valve body 24 forms service passages 34 and 36 in respective communication with the head end and rod end of the jack 12 by means of conduits 38 and 40. The service passages 34 and 36 are in communication with the bore 26 between branched portions of each of the passages 30 and 32.

A hydraulic pump 42 is arranged to draw fluid from a sump or reservoir 44 and deliver fluid under pressure through a conduit 46 to the inlet passage 30. The branched drain passage 32 is also in communication with the sump 44 through a conduit 48. The pressurized conduit 46 is also in conventional communication with the drain conduit 48 by means of a relief valve indicated at 50.

The spool 28 tends to be maintained within the bore 26 at a neutral position as illustrated in the figure by means of a centering spring assembly indicated at 52. The centering spring assembly 52 includes a pair of washers 54 and 56 and a spring 58 arranged for interaction therebetween. These components are mounted upon an extension 60 of the spool 28 in generally conventional fashion. The smaller washer 54 is urged by the spring 58 against an annular end surface 62 of the spool 28 and overlaps the spool to engage valve body 24 about the bore 26. The larger washer 56 is similarly urged by the spring 58 against both a cap screw 64 secured to the spool extension 60 and a shoulder 66 formed about the spool extension 60 by a portion 68 of the valve housing 24.

Differential operation of the spring assembly 52 is accomplished by means of a second spring 70 arranged for interaction between the shoulders 66 and an annular shoulder 72 formed upon a spring adapter 74. The adapter 74 is urged leftwardly by the spring 70 to normally maintain its end 76 in spaced apart relation from the larger washer 56. The adapter 74 also includes a counterbore 78 defining an annular surface 80 normally in spaced apart relation from the smaller washer 54. With this spring arrangement, the spool is movable in a leftward direction against force of the single spring 58 towards a single operating position for communicating the service passage 34 with the drain passage 32 and simultaneously communicating the inlet passage 30 with the other service chamber 36. This position of the spool accordingly serves to cause retraction of the piston 16 within the cylinder 12.

The spool 28 is also movable rightwardly initially against only the force of the inner spring 58 to a first operating position where the washer 54 is urged against the surface 80. With the spool in this position, the service passage 34 is in communication with the inlet passage 30 and the other service passage 36 is in communication with the branched drain passage 32. This operating position of the spool provides for relatively low speed operation of the jack with relatively high force within its head end 20.

The spool 28 is further movable to the right beyond this first operating position. However, its further movement is also resisted by the second spring 70. Accordingly, both of the springs 58 and 70 resist continued rightward movement of the spool 28 toward a second operating position where the spring adapter 74 abuts the larger washer 56. With the spool in this position, the service passage 34 for the head end of the cylinder remains in communication with the inlet passage 30. The other service passage 36 is also placed in communication with the inlet passage 30. In this manner, exhaust fluid from the rod end 22 of the jack provides additional make-up fluid to the head end 20 in order to provide for relatively high speed operation of the jack with effectively reduced operating force in its head end.

Movement of the spool 28 toward the various operating positions described above is accomplished by means of the pilot valve 14. Pilot chambers 82 and 84 are formed by the valve housing at opposite ends of the spool 28. These pilot chambers are in respective communication with the pilot valve 14 by means of separate conduits 86 and 88.

A low volume pump 90 draws fluid from the common sump 44 in order to provide a source of pilot fluid pressure to the pilot valve 14 through a conduit 92. Both the conduit 92 and a separate drain conduit 94 are in communication with the pilot valve 14. The pressurized concuit 92 is also in communication with the sump 44 by means of a conventional relief valve 96.

The pilot valve 14 includes a four-position spool 98 which is adjusted by a manual control lever 100. The spool 98 is movable in a rightward direction from its illustrated neutral position toward a single operating position. Pilot fluid pressure from the pump 90 is thereby directed to the pilot chamber 84 in order to shift the spool 28 leftwardly for causing retraction of the jack 12.

The spool 98 is also movable in a leftward direction toward a first operating position, generally represented at 106, where the pilot fluid pump 90 is in restricted communication with both the pilot chamber 82 and the sump 44. This provides a relatively low actuating pilot pressure in the chamber 82 sufficient to shift the spool 28 against the single spring 58. However, this reduced pilot pressure is insufficient to shift the spool 28 against the combined resistance of both springs 58 and 70. Accordingly, with the pilot spool 98 being shifted leftwardly to its first operating position 106, the control valve spool 28 is moved rightwardly into its first operating position where the washer 54 engages the shoulder 80 on the spring adapter 74.

The pilot spool 98 is further movable to the left into a second operating position generally indicated at 108 wherein substantially full pilot pressure from the pump 90 is communicated to the pilot chamber 82. This relatively increased pressure is sufficient to shift the spool 28 against the force of both springs 58 and 70 in order to move the spool 28 to its second operating position as described above.

The pilot valve 14 is thus operable to selectively position the spool 28 for two speed operation of the jack 12. In order to provide an indication to the operator as to the operating position of the pilot valve, a first spring 102 resists leftward movement of the spool 98 and the manual control element 100 toward both the first and second operating positions 106 and 108. In addition, a second spring 104 resists movement of the spool 98 from its first operating position 106 toward its second operating position 108. This increased spring pressure may be sensed by the operator through the control element 100 to provide a clear indication as to when the control valve spool 28 is being shifted for relatively high speed operation of the jack 12.

Thus, the present pilot operated, control valve provides the operator with positive control over the two operating speeds for the jack 12 in a simple and reliable manner. In addition, the differential pilot springs 102 and 104 serve to clearly indicate to the operator the relative position of the pilot valve 14 and thus the position of the main control valve spool 28 as well as the intended operating speed for the jack 12.

We claim:

1. A pilot operated control valve system for effecting two speed operation of a hydraulic jack in a first direction and also for effecting one speed operation of the jack in the opposite direction, the hydraulic jack being of conventional type and including a cylinder, a piston movable therein, a rod integrally formed with said piston and extending outwardly therefrom, said piston arranged to divide the cylinder into a head end and a rod end, the piston having a greater effective area exposed relative to the head end of the jack as compared to its rod end, the pilot operated control valve system comprising a hydraulic pump a sump, a control valve body defining a bore, an inlet passage for communicating the pump with the bore, at least one drain passage for communicating the bore with the sump, and two service passages for respectively communicating the bore with the head and rod end of the jack, a spool being movably arranged within the bore and forming pilot actuating chambers at either end thereof, the spool being longitudinally movable in its opposite direction toward a sole one operating position to communicate the inlet passage with the rod end of the jack through one of the service passages and to communicate the drain passage with the head end of the jack through the other service passage, the spool also being movable in its first direction by a discrete distance toward a first operating position to communicate the inlet passage with the head end of the jack through the other service passage and to simultaneously communicate the drain passage with the rod end of the jack through the one service passage, the spool being further movable in its first direction an additional discrete distance within the bore toward a second operating position to maintain communication between the inlet passage and the head end of the jack while also communicating the rod end of the jack with the inlet passage by means of the one service passage, centering spring means for providing relatively light resistance to movement of the spool in either direction from a neutral position wherein both the service passages are blocked from communication with either the inlet passage or the drain passage and the inlet passage is communicated to the drain passage, second spring means coaxial with said centering spring means, said second spring means acting in cooperation with said centering spring means solely during movement of the spool between its first and second operating positions for providing increased resistance to movement of the spool toward its second operating position, a source of pilot fluid, and a pilot control valve having a neutral position, a first pilot position for communicating pilot fluid to the pilot chamber in one end of the bore for shifting the spool in said opposite direction, a second position for communicating a restricted flow of pilot fluid to the chamber in the other end of the bore, said restricted flow of pilot fluid being sufficient to overcome the relatively light resistance of the centering spring means and a third position to communicate full pilot flow to the pilot chamber in the other end of the bore in order to overcome the relatively high resistance of the second spring means acting in cooperation with said centering spring means.

2. The pilot operated control valve of claim 1 wherein the pilot control valve includes a manual control element, a first spring for resisting operation of the pilot valve toward both of its second and third positions, and an additional spring for further resisting movement of the pilot valve between its second and third operating positions.

* * * * *